US005238301A

United States Patent [19]

Brady

[11] Patent Number: 5,238,301

[45] Date of Patent: Aug. 24, 1993

[54] VERTICAL UNITIZED COMPARTMENTALIZED SEPARATION/HOLDING CONTAINER

[75] Inventor: Richard E. Brady, Nashville, Tenn.

[73] Assignee: Mill's Pride, Inc., Waverly, Ohio

[21] Appl. No.: 741,315

[22] Filed: Aug. 7, 1991

[51] Int. Cl.[5] ..... A47B 81/00

[52] U.S. Cl. ..... 312/328; 220/909; 248/95; 248/907; 312/242; 312/321.5

[58] Field of Search ..... 248/95, 907; 312/328, 312/321.5, 242, 327; 220/404, 909

[56] References Cited

U.S. PATENT DOCUMENTS

| | | | |
|---|---|---|---|
| 2,636,800 | 4/1953 | Downey | 248/95 X |
| 4,664,455 | 5/1987 | Greenhow | 248/95 X |
| 4,854,497 | 8/1989 | Smith | 248/907 X |

*Primary Examiner*—Peter R. Brown

*Attorney, Agent, or Firm*—Frank H. Foster

[57] ABSTRACT

A structure for a vertical unitized compartmentalized sorting/holding container compatible with plastic bags for use where sundry recyclable materials are generated and discarded. There is provided a retaining apparatus in which the action of discarding, at the same time, sorts and holds various materials for recycling purposes in several sloping rhomboid compartments, one over the other, providing fifty per cent greater holding volume than level rectangular compartments of the same floor space. Further, dull hooks advantageously located hold plastic bags open for filling from the front instead of the top. Pull-down doors, render easy loading, and serve to isolate odors and obscure trash from view. Flat newspaper storage is provided in the bottom. The construction of the container provides for free-standing use in interior or exterior environments and flush in-wall installation.

10 Claims, 3 Drawing Sheets

VERTICAL UNITIZED COMPARTMENTALIZED SEPARATION/HOLDING CONTAINER

BACKGROUND OF THE INVENTION

1. Field of the Invention

This invention relates to waste containers commonly found and used in homes, offices, snack bars and similar locations where packaged food is consumed and diverse classes of garbage are generated, and more particularly relates to containers used to hold various types of refuse in multiple stack or side-by-side units.

2. Description of the Prior Art

Currently, waste containers used for recycling purposes, for the most part, have been adapted from existing units for the use of plastic bags, but common practice is to discard all classifications of trash into one container where it will eventually have to be retrieved and sorted or otherwise several separate containers are required.

Since the mounting urgency of the need to recycle, multiple compartmentalized containers have been described in the art and are more widely used. But in order to separate trash for recycling, usually several side-by-side containers are used and the resulting amount of floor space is prohibitive in many situations. Multiple stackable units require considerable space and are not particularly attractive in the home or office environment. Space in modern homes and business is at a premium.

The need for separation of trash, aluminum, steel, clear and colored glass, plastic and paper is paramount today, since over half the states require recycling under law and the U.S. Senate is considering making it mandatory in all fifty states.

In order for recycling to effectively work, it must be made convenient for the consumer at the point packaging is opened and the trash is generated. Further, the space required for the container used to sort and hold the trash must be kept as small as possible yet with adequate capacity to accomplish the desired results. And, the unit must be of suitable construction and appearance to be accepted in the environment in which it is to be used. This invention fills all the above requirements.

SUMMARY OF THE INVENTION

This invention is a single vertical compartmentalized container unit for sorting and holding trash for recycling purposes, utilizing air space rather than floor space, embodying several sloping rhomboid compartments, one above the other, facilitating front drop-in loading and each accommodating approximately 50% larger volume than a level rectangular compartment occupying the same floor space. The bottom compartment, unlike those above it, has a flat floor for stacking newspapers. A core embodiment of this invention is a means for securing plastic bags in the individual sloping rhomboid compartments so as to be accessible for filling from the front of the container comprising a unique set of upper and lower dull hooks that hold the bags in an open position. The hooks are devised to allow the use of standard plastic kitchen trash bags with tops rolled and tucked behind the retainer as well as accommodating the possible use of special plastic bags with grommet holes to slip over the hooks for optimum ease of placement.

A further important embodiment, a hinged pull-down door, on each compartment is easily activated by a handle and magnetic latching closure with the dual purpose of isolating trash odor and also serves to position and move lower mounting hooks moving lower side of bag opening in such manner as to lay open bags fully to form easy access when the door is opened, and pulling up to partially close the bag to prevent spillage as the door is closed.

Weather-proof construction indicates use on patios and in carports, as dictated by circumstances or convenience, further allowing for flush in-wall installation in new construction and remodeling, protruding only a few inches beyond the outside wall and requiring only a rough opening and furnished extruded trim strip.

It is an object of this invention to provide a structure for sorting and holding in plastic bags, a wide range of trash materials for recycling in a single compact unit with a pleasing appearance, with the minimum amount of space required, thereby so adaptable to serving the needs that it will generally further the practice of recycling.

BRIEF DESCRIPTION OF THE DRAWINGS

FIG. 3*a* shows an upper hook with a special grommeted bag installed. FIG. 3*b* illustrates a lower hook mounted on the door with the a generic plain top bag rolled and inserted in the hook.

FIG. 4*a* shows a single bag installed using four upper and four lower hooks and FIG. 4*b* shows two bags installed using two upper and two lower hooks for each bag.

The invention will be described in connection with a preferred embodiment, but it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
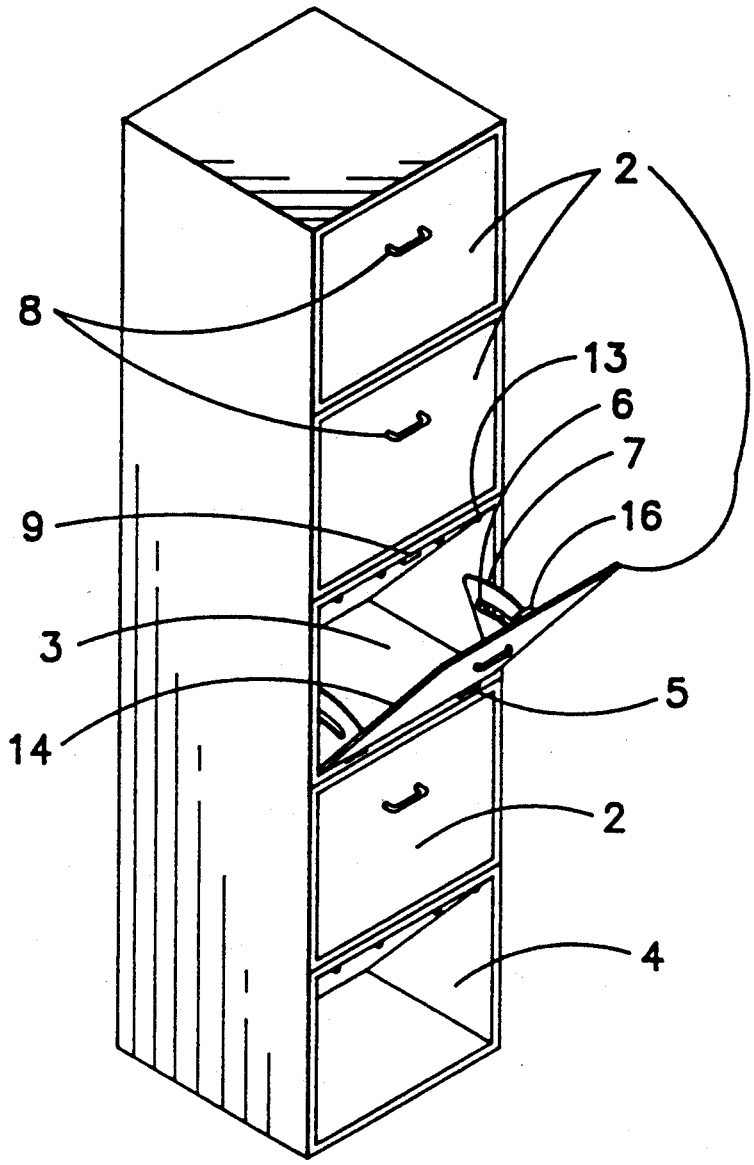
FIG. 1 is a perspective view of the compartmentalized trash sorting/holding unit of the present invention showing one of the sloping rhomboid compartments with doors open exposing the four upper bag retainer hooks, the door limit/spill shield machanism and the magnetic closure. The lowest opening is the flat newspaper storage.

Turning first to FIG. 1 there is shown the vertical unitized compartmentalized trash sorting/holding container of the present invention comprising side, back, bottom and top members fixed together and a front comprised of several pull-down doors 2.

The interior of the container is divided into several sloping rhomboid compartments 3, one over the other, for receipt and holding in plastic bags, aluminum, steel, colored and clear glass, plastic and paper materials. The lowest compartment 4 for receipt of newspapers has a flat floor.

The doors 2 of each compartment operate on hinges 5 at the bottom and provide mounting for lower dull hook bag retainers 14. A door limit/spill shield 6 comprising the means to limit the open position of a door by a slide in a slot in the shield and a stop 7 mounted on the cabinet limiting the open position of the door to the same angle as the bottom of the sloping rhomboid compartment forming a chute effect to facilitate loading. The limit/spill shield 6 further provides means to prevent bags fouling in the door opening, keeping them within the compartment.

Further, a handle 8 is located on the face of the door 2. A means of latching is provided by a two part magnetic mechanism comprised of a magnet 9 at the front underside of the top of each compartment 3 and a ferrous metal plate 16 attached to the top inside of the door.

Figure 2:
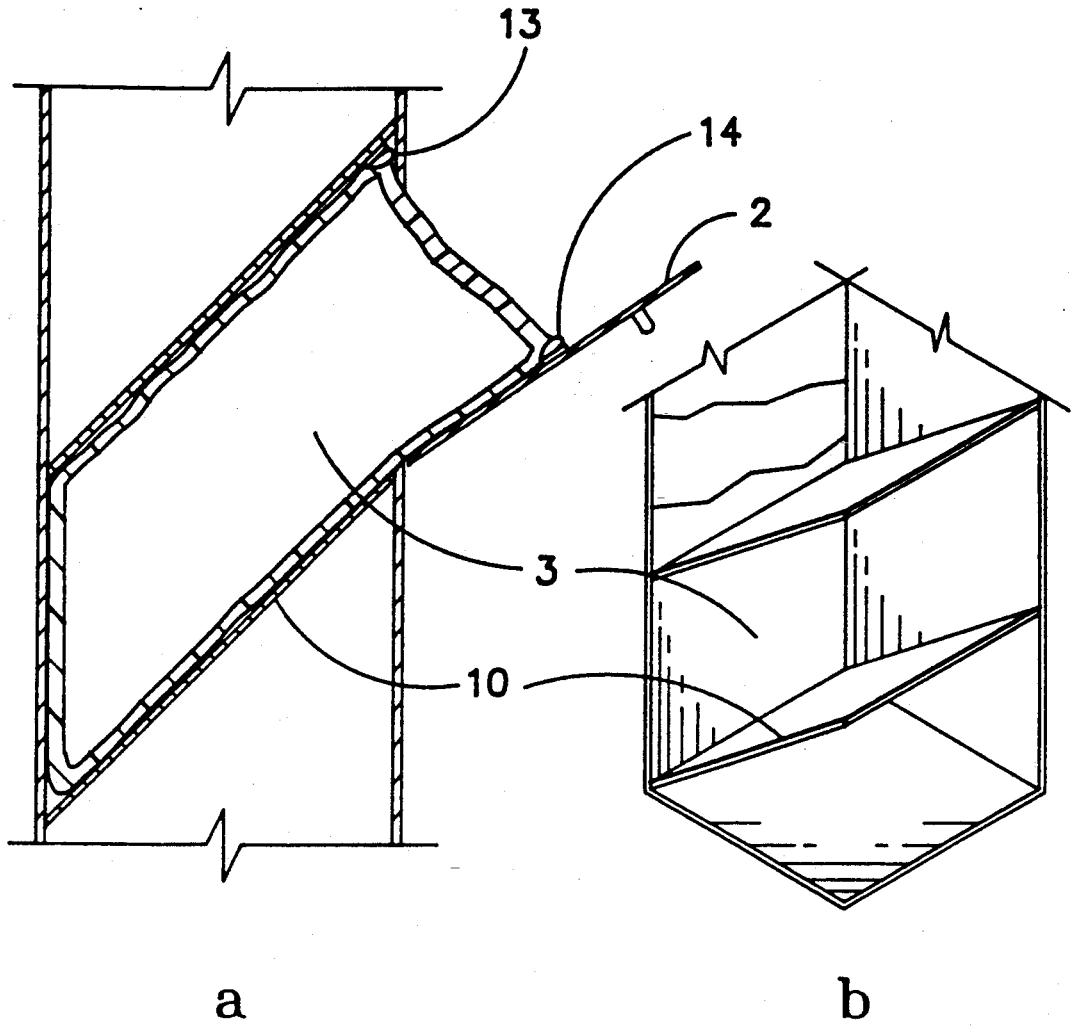
FIG. 2*a* is a side view of a sloping rhomboid compartment with the front door open and shows the bag retainer hooks, advantageously positioned, a set of four across the top immediately inside the door frame and a second set of four approximately half way up the inside of the door. Also shown is the bottom flat open compartment.
FIG. 2*b* is a perspective view with part of the side and the door removed to further define the sloping rhomboid compartment.

FIG. 2 reveals the core of this invention, a typical sloping rhomboid compartment 3, formed by flat shelves 10 retained in a position sloping 45 degrees from front to back inside of the cabinet. This sloping rhomboid configuration provides approximately 50 percent more depth than a level rectangular compartment of the same width occupying the same floor dimension. Therefore, the sloping rhomboid compartment provides approximately 50% more capacity in the same floor space. The slope further facilitates loading, with the trash naturally falling by gravity to the bottom and rear of the compartment.

A further enhancement of the embodiment of the vertical sloping rhomboid compartment configuration is, the top of each compartment becomes the floor of the next, further compacting space in the vertical rather than spread out as in side-by-side or clustered arrangements.

The door 2 is shown in the open position to illustrate its chute effect and the location of the lower bag retainer hooks 14 seen in the next figure.

Figure 3:
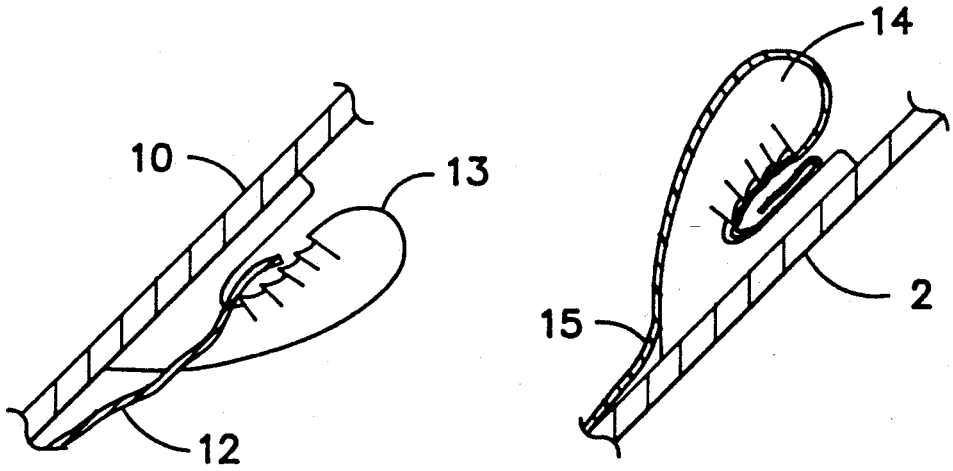
FIG. 3 shows details of the bag retainer hooks.

Turning to FIG. 3 there is shown in detail the unique dull hook bag retainers, identical, except the upper 13, FIG. 3*a* and the lower 14, FIG. 3*b*, are mounted opposed and facing front to receive a bag and are ribbed on the inner side providing means to secure plastic bags open for front loading as opposed to conventional top loading.

Further detail shows a special grommeted bag 12 installed on an upper hook retainer 13, FIG. 3*a* and the alternative generic plain top bag 15 installed on a lower hook retainer 14, FIG. 3*b*.

The dull hook bag retainers 13 and 14 are spaced advantageously to secure the plastic bags, open end facing front in a gaping position at each door frame. During use, one would insert a special bag 12 with properly spaced grommet holes pressed over each of the retainer hooks 13. However, as previously mentioned, a presently available generic 13 gallon plastic trash bag with plain top 15 can be used, by rolling the top a few turns and tucking it in behind the hooks the scoring will securely retain the bag. Removal in both cases is accomplished by merely lifting the bag off the hooks. Each bag can be installed or replaced without interfering with another.

Figure 4:
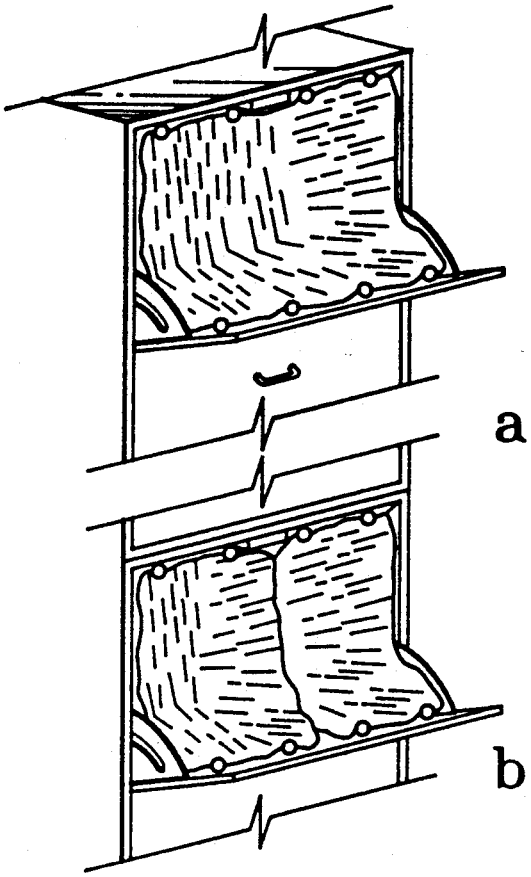
FIG. 4 is a perspective view of a doors opened, with bags installed, further illustrating the location of the upper bag retainer hooks on the lower edge of a shelf and the lower hooks on the inside of the door which pull the lower edge of the bag down and outwardly, open wide when the door is opened.

FIG. 4 shows either one bag FIG. 4*a* or two bags FIG. 4*b* installed in a single compartment. Where convenience indicates, one could install two bags in a single compartment using just two upper and two lower hooks on each; for example, when it is desirable to sort and hold both steel and aluminum cans and/or colored or clear glass in a single compartment using separate bags, offering maximum sorting possibilities.

Figure 5:
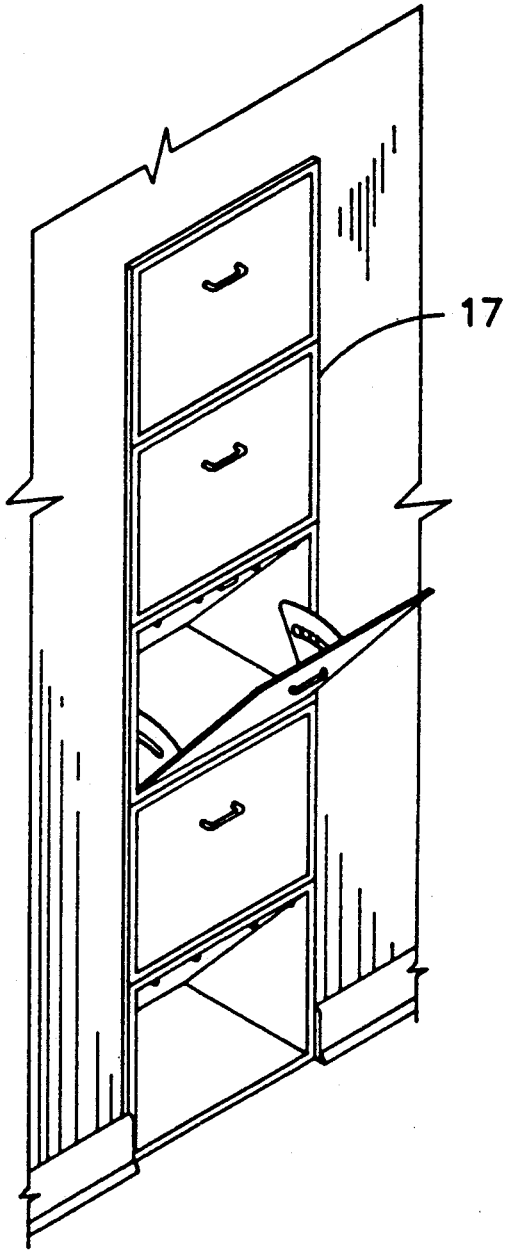
FIG. 5 illustrates the container flush mounted in a wall.

Finally, turning to FIG. 5, the rectangular exterior configuration of the container allows flush mounting through a wall in a rough framed opening and finished inside and out with an extruded trim strip 17, provided. The unit will protrude only a few inches on the other side of the wall offering the ultimate in space saving.

From the foregoing description, it will be apparent that modifications can be made to the apparatus without departing from the teaching of the present invention. Accordingly, the scope of the invention is only to be limited as necessitated by the accompanying claims.

I claim:

1. A vertical unitized compartmentalized sorting/holding container for use with plastic trash bags, and especially for recycling purposes comprising:

outer side rectangular walls, back, top, bottom with inclined partitions connected to the side walls with the slope downward from front to back forming several vertical sloping rhomboid compartments, each directly over the other within a single container unit, conserving floor space;

the lowest compartment with a sloping ceiling and flat floor defined by the inclined partition of the compartment above and the level bottom of the container;

the front of the container comprising a plurality of pulldown hinged doors, each above the other and connected to its separate compartment and pivotably moveable about a horizontal axis away from and toward the plane of the front of the container independently of the other by handles, providing closure;

limit/spill shields attached at outer side edges of each door for preventing spillage and at the same time limiting the open position of the door when rotated outwardly, each limit/spill shield comprising a shield plate having a radiused, closed-end slot, the center of the radius being the door hinge axis, the slot embracing and sliding along a stud connected to the side of the structure and positioned so that when the end of the slot meets the stud, the door opening is limited to the angle of the sloping compartment;

a two piece, magnetic latching mechanism connected to each door and to an inclined partition adjacent said door;

a first set of bag retainer hooks, located on the inclined partition adjacent each door across the top of each compartment to secure the top of a plastic bag in each compartment, and a second set of bag retainer hooks attached to the inside and midway up on the door and opposite the first set of hooks, to retain said plastic bags and automatically positioning the bags in a gaping position for front loading when the door is open.

2. A vertical, compartmentalized, sorting/holding container comprising:

(a) outer side walls with inclined partitions connected to the outer side walls, the inclined partitions sloping downwardly from front to back forming a plurality of vertically arranged sloping compartments having front openings, one above the other; and (b) a plurality of pull-down doors arranged vertically along the front of the container, each connected to an associated separate compartment and pivotably moveable about a horizontal axis away from and toward the plane of the front of the container independently of the others to provide closure.

3. A container in accordance with claim 2 and further comprising a plurality of bag retainers, located immediately inside the front opening across the top of each compartment to secure a top edge of a bag opening, and across the inside of the door, to retain an opposite top edge of the bag opening and for automatically positioning bags in a gaping position for front loading when the door is open.

4. A container in accordance with claim 3 and further comprising:

limit/spill shields connected at opposite outer side edges of the pull-down doors and extending through the front openings into the interior of the compartments for preventing spillage when the doors are rotated outwardly.

5. A container in accordance with claim 4 wherein each of the limit/spill shields has an arcuate slot centered at the pivot axis of the doors and sliding along a stud connected to and protruding from the interior of an outer side wall, the slot having an end wall for engaging the stud when the door is opened to limit the angle of the door when opened.

6. A container in accordance with claim 5 and further comprising a means attached to each door for holding each door closed.

7. A container in accordance with claim 2 and further comprising:

limit/spill shields connected at opposite outer side edges of the pull-down doors and extending through the front openings into the interior of the compartments for preventing spillage when the doors are rotated outwardly.

8. A container in accordance with claim 7 wherein each of the limit/spill shields has an arcuate slot centered at the pivot axis of the doors and sliding along a stud connected to and protruding from the interior of an outer side wall, the slot having an end wall for engaging the stud when the door is opened to limit the angle of the door when opened.

9. A container in accordance with claim 8 and further comprising a means attached to each door for holding each door closed.

10. A container in accordance with claim 2 and further comprising a means attached to each door for holding each door closed.

* * * * *